United States Patent [19]

Cook, III et al.

[11] 4,254,873

[45] Mar. 10, 1981

[54] PALLET

[75] Inventors: James M. Cook, III, Bloomfield Hills; Dennis M. Foy, West Bloomfield; Lyle H. Shuert, Rochester, all of Mich.

[73] Assignee: Oakland Plastics Corporation, Troy, Mich.

[21] Appl. No.: 943,436

[22] Filed: Sep. 18, 1978

[51] Int. Cl.[3] ..... B65D 19/00

[52] U.S. Cl. ..... 206/599; 206/501; 206/600; 108/53.1; 108/55.3

[58] Field of Search ..... 206/386, 599, 600, 501; 108/53.1, 55.3, 55.5, 51.1

[56] References Cited

U.S. PATENT DOCUMENTS

| | | | |
|---|---|---|---|
| 3,140,672 | 7/1964 | De Luca | 108/55.3 X |
| 3,526,195 | 9/1970 | Maryonovich | 108/53.1 |
| 3,640,229 | 2/1972 | Bell | 108/51.1 |
| 3,736,885 | 6/1973 | Freund | 108/51.1 |
| 3,750,596 | 8/1973 | Box | 108/53.1 |
| 3,768,423 | 10/1973 | Cook III et al. | 108/51.1 |
| 3,868,915 | 3/1975 | Hafner | 108/53.1 X |
| 3,948,190 | 4/1976 | Cook III et al. | 206/599 |
| 4,000,704 | 1/1977 | Griffin, Jr. | 206/599 X |

FOREIGN PATENT DOCUMENTS

| | | | |
|---|---|---|---|
| 2054381 | 5/1972 | Fed. Rep. of Germany | 108/53.1 |
| 2461711 | 7/1976 | Fed. Rep. of Germany | 108/51.1 |
| 1486545 | 9/1977 | United Kingdom | 108/51.1 |

*Primary Examiner*—Joseph Man-Fu Moy
*Attorney, Agent, or Firm*—McGlynn and Milton

[57] ABSTRACT

A pallet system including two embodiments of a pallet having a deck including four sides and providing a load-supporting surface. A plurality of spaced hollow legs project from the opposite side of the deck and a plurality of hollow reinforcing ribs project from the opposite surface to define channels in the load-supporting surface. A hollow ridge projects from the opposite surface and extends along the sides at the periphery of the deck to define a groove in the load-supporting surface for receiving the bottom edge of a wall. There is at least one transverse rib projecting from the opposite surface and extending between opposite sides of the deck to define a transverse groove in the load-supporting surface for receiving the bottom edge of a transverse wall whereby walls may extend upwardly from the deck to divide and separate the load-supporting surface into discrete areas. The channels defined by the reinforcing ribs have a larger dimension than do the grooves defined by the ridges for receiving the edges of walls. The reinforcing ribs include a first plurality of ribs extending between corner legs and parallel to opposite sides with a second plurality of ribs extending perpendicular to the first plurality of ribs and having ends terminating short of the first plurality of ribs so as to be spaced therefrom.

17 Claims, 9 Drawing Figures

PALLET

BACKGROUND OF THE INVENTION (1) Field of the Invention

This invention relates to a pallet made of plastic or organic polymeric material. Such pallets are handled by forklift vehicles and are four-sided or rectangular in configuration and have an upper load-supporting surface or platform section upon which articles are disposed for handling, storage and transporting.

(2) Description of the Prior Art

Plastic pallets are widely used as they have various advantages over previously used wooden pallets such as being cheaper to manufacture, easier to store, lighter in weight, etc. There are always attempts, however, to provide pallet systems made of plastic, which are inexpensive and incorporate desired features yet allow the pallet systems to have the requisite strength characteristics for particular uses.

SUMMARY OF THE INVENTION

The subject invention relates to a pallet system including a pallet made of organic polymeric material and being of unitary structure having a deck including four sides and providing a load-supporting surface. A plurality of spaced, hollow legs project from the opposite surface of the deck as do a plurality of hollow reinforcing ribs which define channels in the load-supporting surface. Additionally, a hollow ridge projects from the opposite surface and extends along the sides at the periphery of the deck to define a groove in the load-supporting surface about the periphery thereof for receiving the bottom edge of a wall. Further, at least one transverse rib projects from the opposite surface and extends between opposite sides of the deck to define a transverse groove in the load-supporting surface for receiving the bottom edge of a transverse wall whereby walls may extend upwardly from the deck to divide and separate the load-supporting surface into discrete areas. The channels which are defined by the reinforcing ribs have a different dimension than the grooves defined by the ridges for receiving the edges of the walls thereby defining a load-supporting surface which may be divided into discrete areas.

PRIOR ART STATEMENT

Various different pallet systems are known in the prior art including pallets which are made of an organic polymeric or plastic material. An example of such a pallet is shown in U.S. Pat. No. 3,768,423 granted to James M. Cook III et al on Oct. 30, 1973. The pallet illustrated in that patent and many other pallets have particular structural features providing a pallet satisfactory for certain uses from the standpoint of manufacturing the pallet and the desired strength characteristics. The subject pallet is particularly suited for manufacture by vacuum forming yet providing the requisite strength characteristics for specified uses. One of the uses to which the pallet of the subject invention may be put is that it may be employed in a pallet system including a top whereby walls may be supported in grooves on the pallet with the top engaging the top edges of the walls and further with transverse grooves for receiving walls which divide or compartmentalize the pallet. Pallet systems are known which include bottom and tops with walls in between as exemplified by British Patent Specification No. 807,571 published Jan. 21, 1959. In that system there is no teaching of dividing the pallet into various areas nor of the specific structural configurations of the subject pallet system which facilitates the making of the pallet and the top by vacuum molding with the pallet and the top having the requisite strength characteristics and being capable of being stacked.

DESCRIPTION OF THE PREFERRED EMBODIMENT

Figure 1:
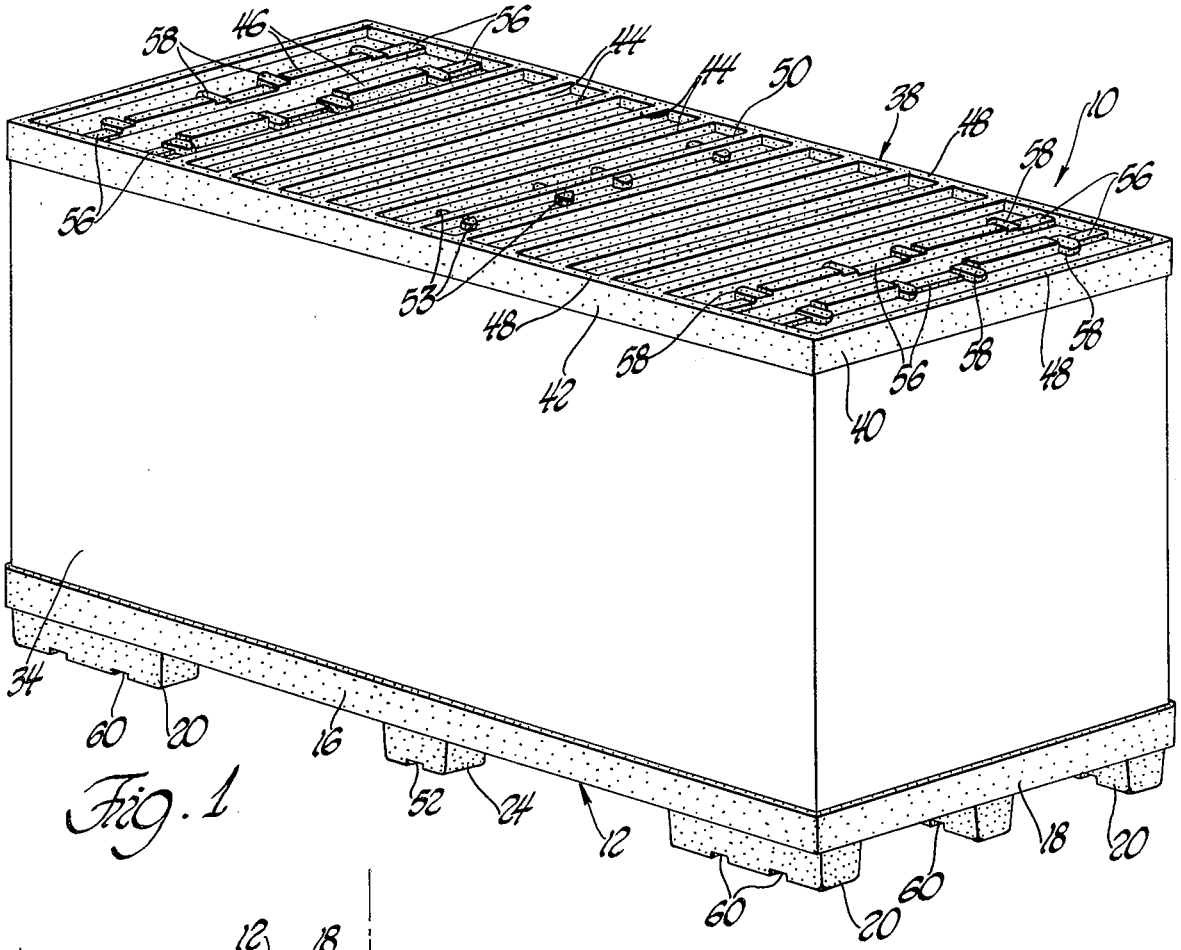
FIG. 1 is a perspective view of a pallet system including a pallet with walls extending upwardly therefrom and a top disposed on the top edge of the walls.
Figure 2:
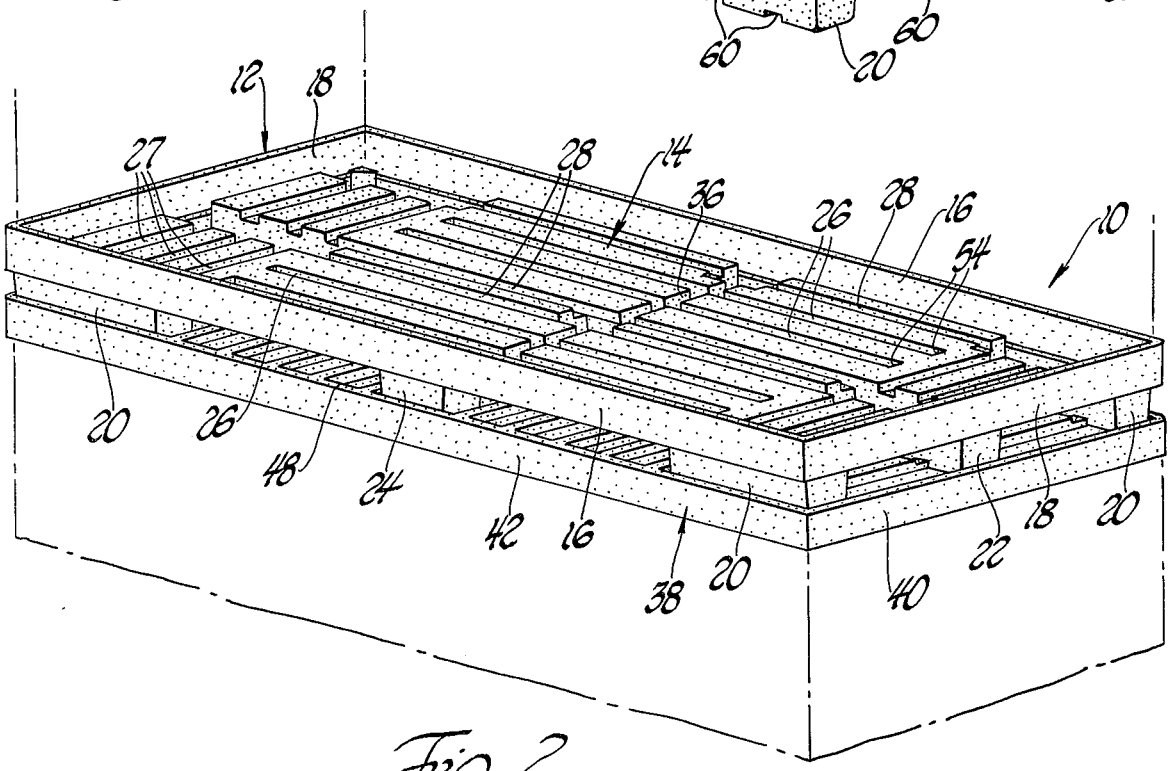
FIG. 2 is a perspective view showing the pallet of FIG. 1 stacked upon the top shown in FIG. 1 with the walls shown in phantom.
Figure 3:
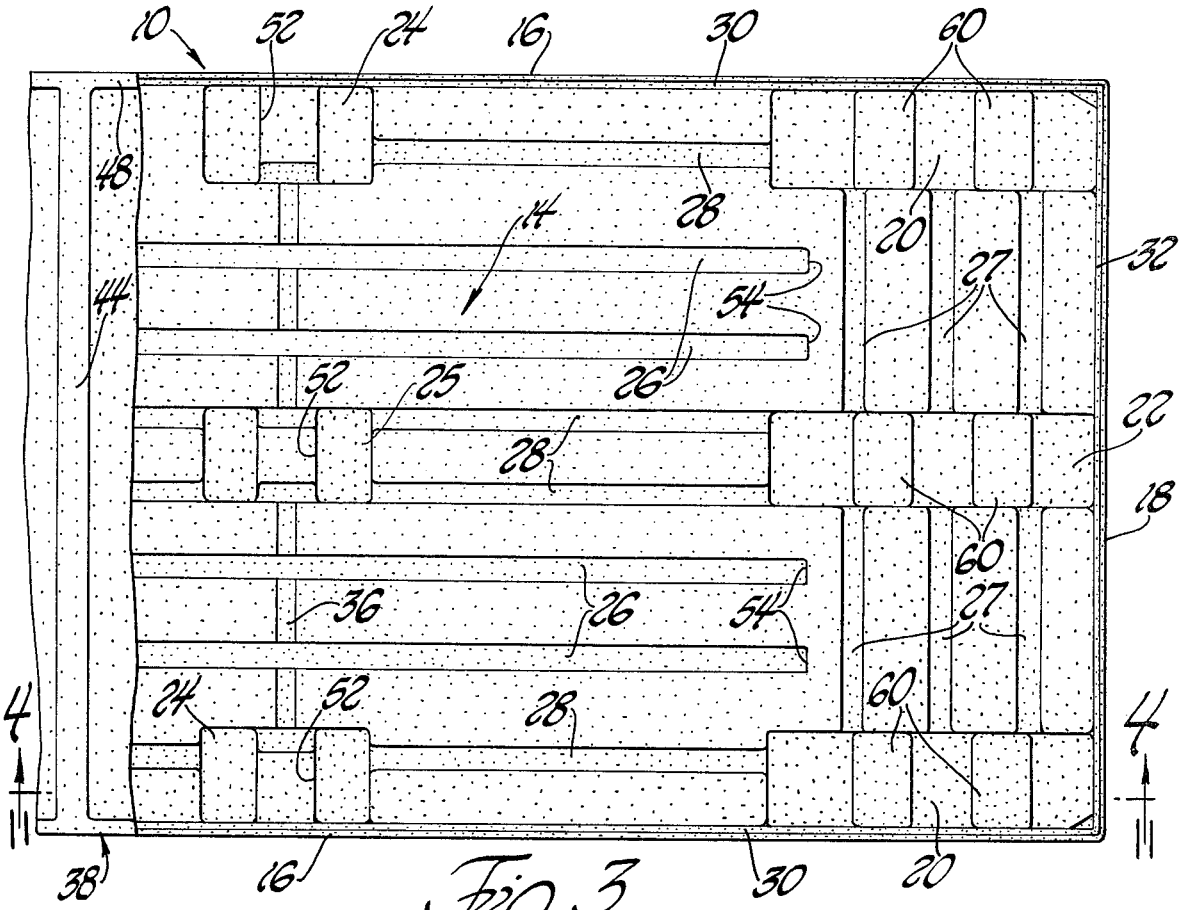
FIG. 3 is a plan view showing the load-supporting surface of the pallet shown in FIGS. 1 and 2.
Figure 4:
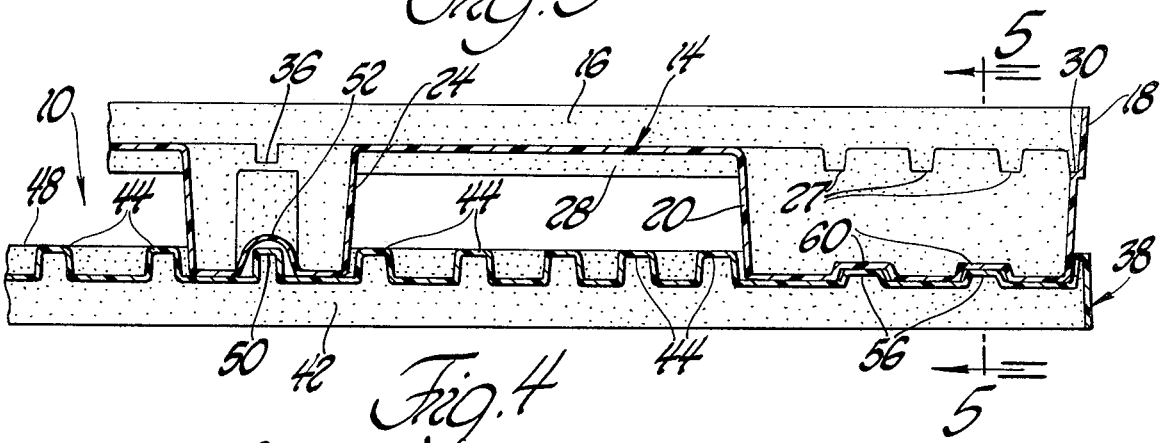
FIG. 4 is a cross-sectional view taken substantially along line 4—4 of FIG. 3.
Figure 5:
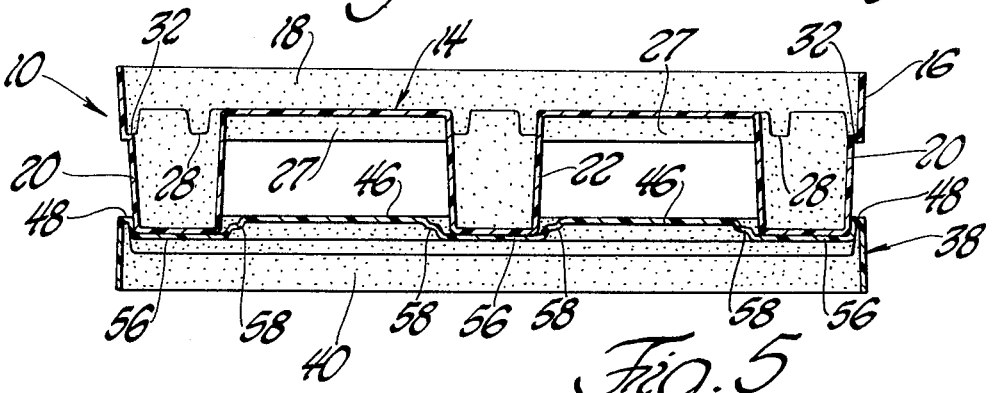
FIG. 5 is a cross-sectional view taken substantially along line 5—5 of FIG. 4.

A first embodiment of a pallet system constructed in accordance with the subject invention is generally shown at 10 in FIGS. 1 through 5.

The pallet system 10 includes a pallet generally indicated at 12. The pallet 12 is made of an organic polymeric or plastic material and is of a unitary or integral structure having a deck or platform generally indicated at 14 including four sides surrounding the load-supporting surface defined by the deck 14. The pallet is elongated to define a rectangular shape with the side edges defined by the flanges 16 and the end extremities being defined by the flanges 18. A plurality of spaced, hollow legs or pedestals project from the opposite side of the deck 14 and comprise corner legs or pedestals 20 and middle legs or pedestals 22, 24 and 25 respectively.

A plurality of hollow reinforcing ribs 26, 27 and 28 project from the opposite surface or downwardly from the bottom surface of the pallet to define channels in the load-supporting surface or deck 14. A hollow ridge 30 and 32 projects from the surface opposite to the load-supporting surface or deck 14, i.e., the ridge 30 and 32 projects from the bottom. The ridge 30 and 32 extends along the sides completely about the periphery of the deck or load-supporting surface 14 to define a groove in the load-supporting surface for receiving the bottom edge of a wall 34. Also included is at least one transverse hollow ridge 36 projecting from the bottom surface and extending between opposite sides of the deck 14 to define a transverse groove in the load-supporting surface or deck 14 for receiving the bottom edge of a transverse wall (not shown) whereby walls may extend upwardly from the deck 14 to divide and separate the load-supporting surface of the deck 14 into discrete areas. In other words, the space above the pallet 12 may be divided into compartments. The flanges 16 and 18 are part of an integral single flange extending upwardly above the load-supporting surface 14 of the deck about the outer periphery thereof and define the outer wall of the grooves 30 and 32. The flanges 16 and 18 engage the outer surface of the wall 34 disposed in the grooves 30 and 32. The channels defined by the reinforcing ribs 26, 27 and 28 have a different dimension than the grooves defined by the ridges 30, 32 and 36 in that the grooves are narrower than the channels.

The system also includes a top generally indicated at 38 comprising a unitary or integral structure made of organic polymeric or plastic material the same as the pallet 12. The top 38 has four sides defined by the end flanges 40 and the side flanges 42 which are integral to define one flange extending completely about the periphery of the top and extending downwardly from a top surface. The top 38 also has a bottom surface facing downwardly. The top 38 is of the same size as the pallet 12.

The top 38 includes hollow reinforcing ribs 44 and 46 projecting upwardly from the top surface to define channels in the bottom surface. In addition, a hollow ridge 48 projects from the top surface and extends along the sides at the periphery of the top surface to define a groove for receiving the top edge of the wall 34. The flanges 40 and 42 extend downwardly from the periphery of the top to define the outer wall of the grooves defined by the ridge 48 for engaging the outer surface of the top of the wall 34 disposed in the groove in the top.

There is also included at least one hollow transverse ridge 50 projecting from the top surface and extending between opposite sides 42 of the top surface to define a transverse groove for receiving the top edge of a transverse wall (not shown).

The hollow legs or pedestals include the corner legs 20 disposed at the respective corners of the pallet 12 and at least three middle legs 24 and 25 with two of those middle legs 24 disposed midway along opposite side 16 of the pallet and a center leg 25 disposed at the middle or center of the deck 14. Each of these middle legs 24 and 25 have a recess 52 extending thereacross. The recesses 52 are aligned along a straight line for receiving the transverse ridge 50 of the top 38 as the pallet is disposed upon the top as illustrated in FIGS. 2 through 5. Short, hollow projections 53 extend laterally from the transverse ridge 50 of the top 38 for engaging the sides of the middle legs 24 and 25 of the pallet to prevent lateral shifting between the pallet and the top as a pallet is disposed upon a top. The projections 53 have an upper extremity disposed below the top or upper extremity of the transverse ridge 50. This has been found to be an important feature in increasing the strength of the top 38.

The reinforcing ribs of the pallet 12 include a first plurality of ribs 27 extending between the corner legs 20 as they intersect with the end middle legs 22. The reinforcing ribs 27 are parallel to the opposite end sides 18. The ribs of the pallet also include a second plurality of ribs 26 extending perpendicular to the first plurality of ribs 27 and which have ends 54 terminating short of the first plurality of ribs 27 so as to be spaced therefrom. This has been found to be an important feature in a pallet which is formed by vacuum forming to prevent weak areas in the pallet.

In the top, the reinforcing ribs 44 and 46 and the transverse ridge 50 are all parallel to one another and extend between the opposite lateral sides 42 with the opposite sides 42 being joined by the end sides 40. The reinforcing ribs 46 of the top which are next adjacent the end sides 40, i.e., the two reinforcing ribs 46 adjacent each end of the top, have lowered portions 56 and additional short, hollow projections 58 extending laterally therefrom at the ends of the lowered portions 56. The main portion of the reinforcing ribs 46 are at a different height than the projections 58 and at a different height than the lowered portions 56, the lower portions 56 being lower than the projections 58 and the projections 58 being lower than the main portion of the reinforcing ribs 46, again a feature found to improve the strength of the system.

The corner legs 20 and the end middle legs 22 of the pallet have depressions 60 in the bottoms thereof for disposition upon the lowered portions 56 of the reinforcing ribs 46 in the top. The projections 58 extend laterally from opposite sides of the two reinforcing ribs 46 at each end of the pallet and engage the sides of the legs 20 and 22 for preventing relative lateral movement between the top and the pallet. The depressions 60 in the legs 20 and 22 are more shallow than the recesses 52 in the middle legs 24 and 25 as the lowered portions 56 are not as high as the ridge 50 in order to increase the structural integrity of the top along the reinforcing ridges 46.

The first plurality of reinforcing ribs 27 of the pallet 12 are parallel to the reinforcing ribs 44 and 46 of the top 38 when the pallet 12 is disposed upon the top 38 as illustrated in FIGS. 2 through 5.

Figure 6:
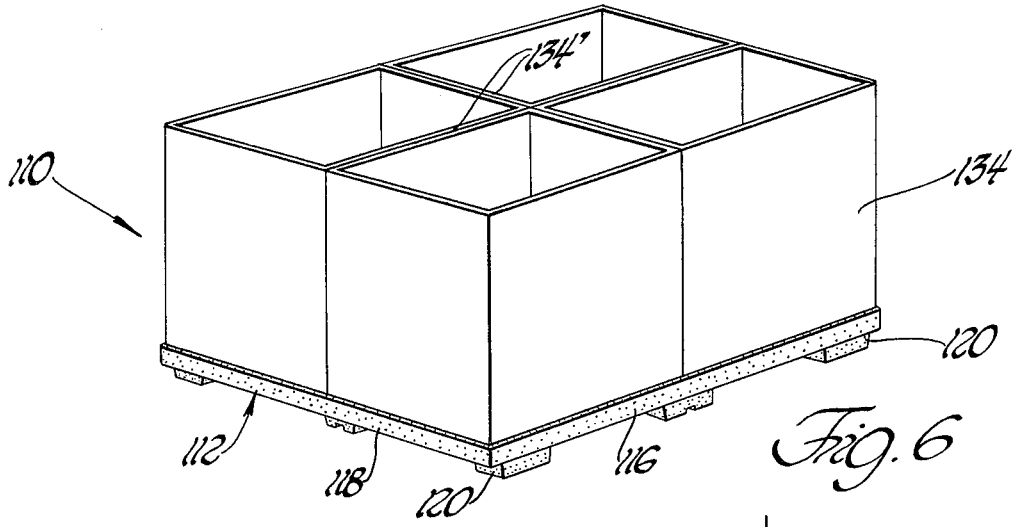
FIG. 6 is a perspective view of another embodiment of the pallet of the subject invention.
Figure 7:
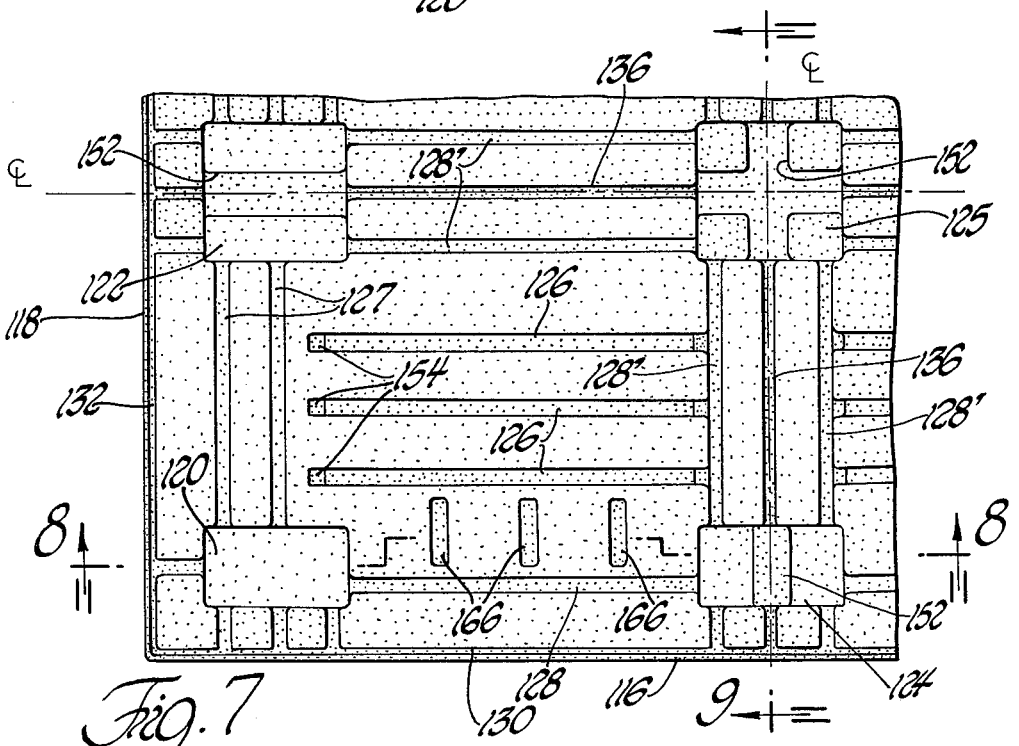
FIG. 7 is a fragmentary plan view of the load-supporting surface of the pallet illustrated in FIG. 6.
Figure 8:
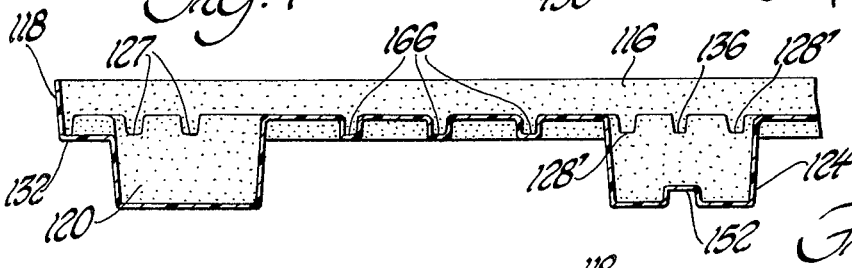
FIG. 8 is a fragmentary cross-sectional view taken substantially along 8—8 of FIG. 7.
Figure 9:
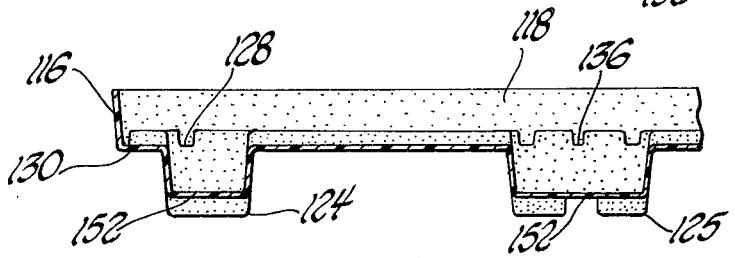
FIG. 9 is a fragmentary cross-sectional view taken substantially along line 9—9 of FIG. 7.

An alternative embodiment of the invention is generally shown at 110 in FIG. 6. The system 110 includes a pallet generally indicated at 112 also having sides defined by the flanges 116 and 118. The pallet also includes the corner legs or pedestals 120 and the middle pedestals 122, 124 and 125, the pedestal 125 being a central pedestal. The pallet 112 also includes the reinforcing ribs 126, 127 and 128 defining channels facing upwardly from the deck surface of the pallet. The pallet also includes the ridges 130 and 132 defining a groove extending completely about the periphery of the pallet for receiving the lower edge of the walls 130. Again, the flanges 116 and 118 define the outer periphery and extend upwardly from the ridges 130 to engage the outer surfaces of the walls 134 disposed in the grooves defined by the ridges 130 and 132.

The pallet 112 also includes the transversely disposed ridges 136 defining grooves into which the dividing wall members 134' may be disposed. Again, the grooves defined by the ridges 130, 132 and 136 are narrower than are the reinforcing ribs of the pallet. The hollow ridges 136 are disposed perpendicular to one another for dividing the deck or lowered supporting surface of the pallet 112 into quadrants as best illustrated in FIG. 6. The corner legs or pedestals 120 have flat bottoms.

The middle legs or pedestals 122, 124 and 125 include recesses 152 with accommodate transversely disposed ridges in a top suitable for use with the pallet 112 in which ridges the top edges of the walls 134, 134' are disposed.

In a fashion similar to the first-described pallet 12, the pallet 112 includes a plurality of reinforcing ribs 126 having ends 154 which terminate short of another plurality of reinforcing ribs 127 so as to be spaced therefrom.

The pallet 112 includes five middle legs 122, 124 and 125 with one of the legs 122 and 124 disposed midway along each of the sides 116 and 118 with a center leg 125 having crossed recesses 152 aligned with respective recesses 152 in the other middle legs 122 and 124. The pallet 112 also includes a third plurality of reinforcing ribs 128' interconnecting the center leg 125 and the other middle legs 122 and 124. In other words, the reinforcing ribs 128' extend transversely to one another from the middle of the pallet to the opposite sides thereof. Further, the pallet 112 includes short secondary reinforcing ribs 166 projecting from the opposite or bottom surface of the pallet 112 and extending transversely to the second plurality of ribs 126 with the opposite ends of each of the secondary ribs 166 terminating short of the adjacent ribs 126 and 128 so as to be spaced therefrom.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, the invention may be practiced otherwise than as specifically described.

The embodiments of the invention in which an exclusive property or privilege is claimed are defined as follows:

1. A pallet system comprising: a pallet made of organic polymeric material; said pallet being a unitary structure having a deck including four sides and providing a load-supporting surface; a plurality of spaced, hollow legs projecting from the opposite surface of said deck; a plurality of hollow reinforcing ribs projecting from said opposite surface to define channels in said load-supporting surface; a hollow ridge projecting from said opposite surface and extending continuously along said sides and completely about the periphery of said deck to define a peripheral groove in said load-supporting surface; a panel defining a wall with an edge of said wall disposed in said groove to define a lateral enclosure; at least one transverse ridge projecting from said opposite surface and extending between opposite sides of said deck to define a transverse groove in said load-supporting surface for receiving the bottom edge of a transverse wall whereby walls may extend upwardly from said deck to divide and separate said load-supporting surface into discrete areas; said channels defined by said reinforcing ribs having a different dimension than said grooves defined by said ridges; and including a flange extending vertically upwardly above said load-supporting surface of said deck about the outer periphery thereof and defining the outer wall of said groove and engaging the outer surface of said wall disposed in said groove in said pallet.

2. A system as set forth in claim 1 including a top comprising a unitary structure made of organic polymeric material, said top having four sides and a top surface and a bottom surface, said top being of the same size as said pallet, hollow reinforcing ribs projecting from said top surface to define channels in said bottom surface, a hollow ridge projecting from said top surface and extending along said sides at the periphery of said top surface to define a groove for receiving the top edge of the wall, at least one hollow transverse ridge projecting from said top surface and extending between opposite sides of said top surface to define a transverse groove for receiving the top edge of the transverse wall.

3. A system as set forth in claim 2 wherein said grooves are narrower than said channels.

4. A system as set forth in claim 3 wherein said hollow legs include a corner leg at each respective corner and at least three middle legs with two disposed midway along opposite sides and a center leg disposed at the middle of said deck, each of said middle legs having a recess extending thereacross, said recesses being aligned along a straight line for receiving the transverse ridge of a top as said pallet is disposed upon the top.

5. A system as set forth in claim 4 wherein said reinforcing ribs of said pallet include a first plurality of ribs extending between said corner legs and parallel to opposite sides and a second plurality of ribs extending perpendicular to said first plurality of ribs and having ends terminating short of said first plurality of ribs so as to be spaced therefrom.

6. A system as set forth in claim 5 including a flange extending downwardly from the periphery of said top to define the outer wall of said groove therein for engaging the outer surface of a wall disposed in said groove in said top.

7. A system as set forth in claim 6 including short hollow projections extending laterally from said transverse ridge of said top for engaging the sides of said middle legs of said pallet.

8. A system as set forth in claim 7 wherein said projections are disposed below said transverse ridge of said top.

9. A system as set forth in claim 8 wherein said reinforcing ribs of said top and said transverse ridge thereof are all parallel to one another and extend between opposite sides thereof; said opposite sides being joined by end sides; said reinforcing ribs of said top next adjacent said end sides having lowered portions with additional short hollow projections extending laterally therefrom at the ends of said lowered portions; said reinforcing ribs, said projections and said lowered portions being at different heights; said corner legs of said pallet having depressions in the bottoms thereof for disposition upon said lowered portions.

10. A system as set forth in claim 9 wherein said first plurality of reinforcing ribs of said pallet are parallel to said reinforcing ribs of said top as said pallet is disposed upon said top.

11. A system as set forth in claim 10 wherein said depressions in said corner legs are more shallow than said recesses in said middle legs.

12. A system as set forth in claim 6 including five of said middle legs with one disposed midway along each side, said center leg having crossed recesses therein aligned with respective recesses in said other middle legs.

13. A system as set forth in claim 13 including a third plurality of reinforcing ribs interconnecting said center leg with said other middle legs.

14. A system as set forth in claim 13 including short, secondary reinforcing ribs projecting from said opposite surface of said pallet and extending transversely to said second plurality of ribs with the opposite ends of each of said secondary ribs terminating short of adjacent ribs so as to be spaced therefrom.

15. A system as set forth in claim 1 wherein said grooves are narrower than said channels.

16. A system as set forth in claim 15 wherein said reinforcing ribs of said pallet include a first plurality of ribs extending between said corner legs and parallel to opposite sides and a second plurality of ribs extending perpendicular to said first plurality of ribs and having ends terminating short of said first plurality of ribs so as to be spaced therefrom.

17. A system as set forth in claim 16 including two of said transverse ridges disposed perpendicular to one another to define perpendicular transverse grooves for dividing said deck into quadrants.

* * * * *